United States Patent [19]

Maher et al.

[11] 4,336,766

[45] Jun. 29, 1982

[54] ROLL FUSING APPARATUS FOR ELECTROPHOTOGRAPHY AND RELEASE AGENT MANAGEMENT SYSTEM THEREFOR

[75] Inventors: James C. Maher; Michael Carlotta, both of Sodus, N.Y.

[73] Assignee: Xerox Corporation, Stamford, Conn.

[21] Appl. No.: 209,578

[22] Filed: Nov. 24, 1980

[51] Int. Cl.[3] ..... G03G 15/20

[52] U.S. Cl. ..... 118/60; 432/60; 432/228; 226/179; 430/99

[58] Field of Search ..... 118/651, 652, 60, 203; 226/179; 432/60, 228; 430/99

[56] References Cited

U.S. PATENT DOCUMENTS 3,856,462 12/1974 Mueller ..... 432/60

3,964,431 6/1976 Namiki ..... 118/60

*Primary Examiner*—John D. Welsh

[57] ABSTRACT

Roll fuser apparatus and a release agent management system therefor. The fuser comprises a pair of pressure engageable rolls one of which is heated and has a relatively thick silicone rubber outer layer. The fuser is adapted to accommodate various size copy sheets resulting in a number of areas of the silicone rubber undergoing physical changes due to the effects of sheet edge contact therewith. The release agent management system is designed to minimize the adverse effects caused by the sheet edges contacting the silicone rubber outer layer. To this end the system which serves to dispense silicone oil onto the surface of the silicone rubber is provided with a plurality of apertures which are strategically located such that a quantity of the oil is introduced into the silicone rubber in these areas of sheet edge contact whereby the adverse effects noted are counteracted.

3 Claims, 4 Drawing Figures

ROLL FUSING APPARATUS FOR ELECTROPHOTOGRAPHY AND RELEASE AGENT MANAGEMENT SYSTEM THEREFOR

BACKGROUND OF THE INVENTION

This invention relates generally to xerographic copying methods and apparatus, and more particularly, it relates to the heat and pressure fixing of particulate thermoplastic toner by direct contact with a heated fusing member having a release fluid on the surface thereof.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to apply heat and pressure to the toner material such that the constituents of the toner material coalesce and become tacky. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of pressure engaged roller members, at least one of which is internally heated. During operation of a fusing system of this type, the support member to which the toner images are electrostatically adhered is moved through the nip formed between the rolls with the toner image contacting the fuser roll to thereby effect heating of the toner images within the nip. By controlling the heat transferred to the toner, visually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquify and cause a splitting action in the molten toner resulting in "hot offset". Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, known by the trade name, Teflon to which a release agent such as silicone oil is applied, the thickness of the Teflon being on the order of several mils and the thickness of the oil being less than 1 micron. Silicone based oils, (polydimethylsiloxane), which possess a relatively low surface energy, have been found to be materials that are suitable for use in the heated fuser roll environment where Teflon constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of adhesive material to a rigid core or substrate such as the solid Teflon outer surface or covering of the aforementioned arrangement.

In attempts to improve at least the perceived quality of the image fused or fixed by a heated roll fuser, such rolls have been provided with conformable surfaces comprising silicone rubber. As in the case of the Teflon coated fuser roll release fluids such as silicone based oils have been applied to the surface of the silicone rubber to both minimize offsetting and to facilitate stripping. See, for example, U.S. Pat. No. 3,964,431.

One drawback with fuser rolls having conformable surfaces comprising silicone rubber is the effect that the copy sheet edges have on the rubber. In these areas contacted by the sheet edges the rubber is worn and/or compacted. Such changes in the physical characteristics of the rubber result in poor fusing.

One approach to eliminating or minimizing the effects of roll wear and/or compaction due to sheet edge contact is described in U.S. Pat. No. 3,856,462. In this patent the rolls on relatively shiftable so that the area of contact between the roll and the sheet edge can be periodically changed. Optimally it is desirable to eliminate or minimize wear and/or compaction rather than compensating for the adverse effects created thereby. As will be appreciated this cannot be accomplished by roll shifting since wear and/or compaction is allowed to occur with the effects thereof being minimized by the shifting.

BRIEF SUMMARY OF THE INVENTION

The present invention solves the problems caused by the edges of copy sheets contacting the silicone rubber surface of the heated fuser roll.

To this end, a release agent management system which contacts the surface of a conformable fuser roll is designed to dispense release agent at predetermined locations on the fuser roll surface corresponding to areas adjacent to the areas contacted by the sheet edges. The fuser roll cooperates with pressure roll to form a nip through which copy sheets of various sizes can be moved in order to fuse the toner images carried thereby.

By way of example, an end registered fuser is contemplated. In this type of fuser one edge of the copy sheets regardless of its size contacts the same surface area of the rolls while the other edges of the various sheet contact different areas of the fuser. Thus, there would be one area of contact for the registration end of the fuser and one area each for each different size copy sheet used. In other words if three different size copy sheets were to be used then there would be four (i.e. one for the registration end and one for each of the opposite edges of the three sheets) such areas of contact. In accordance with the invention, the release agent system comprises a wick holder into which silicone oil is pumped from a reservoir. The holder is provided with a plurality of apertures. The number of apertures is at least equal to the number of areas contacted by the various sheet edges and the apertures are located such that sufficient quantities of release agent are introduced into the silicone rubber in the areas contacted by the sheet edges to thereby counteract the adverse effects of sheet edge contact.

DETAILED DESCRIPTION OF THE DRAWINGS

DETAILED DESCRIPTION OF THE PREFERRED EMBODIMENT

Figure 1:
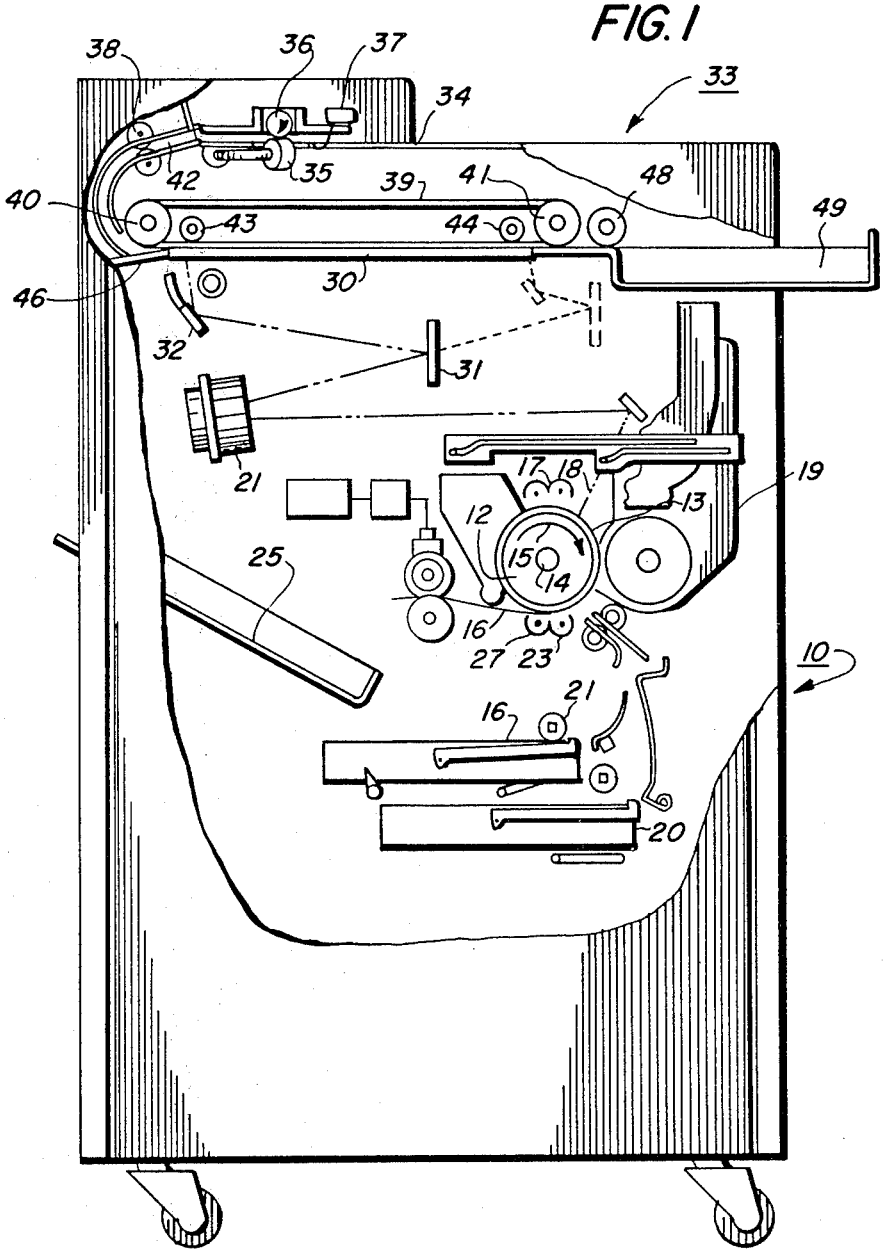
FIG. 1 is a side elevational view partly broken away of a xerographic reproducing apparatus incorporating the invention.

Referring now to FIG. 1 there is shown by way of example an automatic xerographic reproducing machine 10. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like. The practice of xerography is well known in the art and is the subject of numerous patents.

Initially, the drum 12 moves the photoconductive surface 13 through a charging station 17 where an electrostatic charge is placed uniformly over the photoconductive surface 13 in a well known manner preparatory to imaging. Thereafter, the drum 12 is rotated to exposure station 18 wherein the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a developer mix is applied to the photoconductive surface 13 of the drum 12 rendering the latent image visible. Typically a suitable development station could include a magnetic brush development system utilizing a magnetizable developer mix having coarse ferromagnetic carrier granules and toner coolant particles. The developer mix will include particular electroscopic material commonly referred to as toner. For purposes of the present invention the toner is of the type which is normally utilized in conjunction with a heat and pressure fuser.

Sheets 16 of the final support material are supported in a stack arrangement on an elevating stack support tray 20. With the stack at its elevated position a sheet separator 21 feeds individual sheets therefrom to the registration system 22. The sheet is then forwarded to the transfer station 23 in proper registration with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired is transported through a detack station where detack corotron 27 uniformly charges the support material to facilitate separation thereof from the drum 12.

After the toner image has been transferred to the sheet of final support material 16, the sheet with the image thereon is advanced to a suitable fuser 24 which coalesces the transferred powder image thereto. After the fusing process the sheet 16 is advanced to a suitable output device such as a tray 25.

Figure 2:
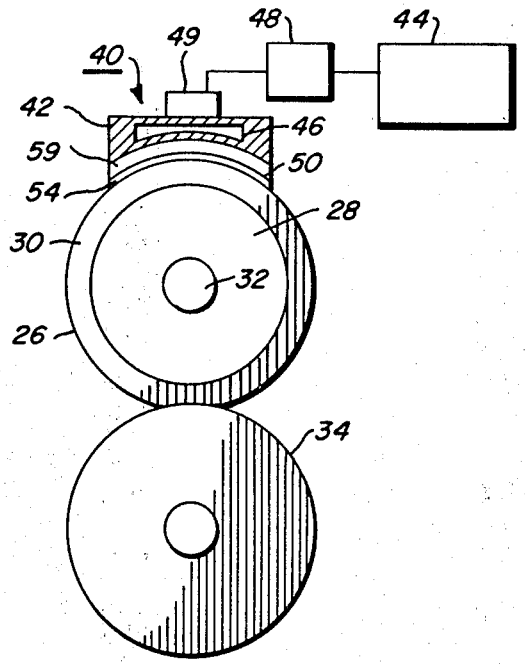
FIG. 2 is a schematic side elevational view of a roll fuser incorporating the present invention.
Figure 3:
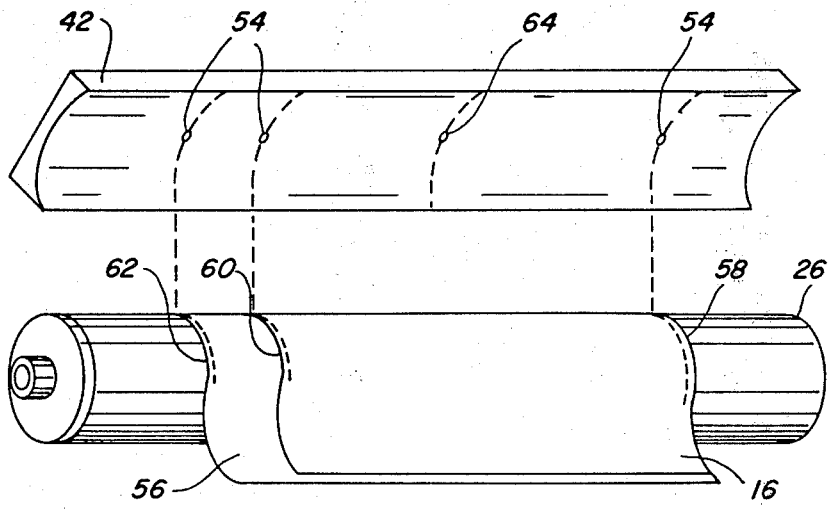
FIG. 3 is an exploded view of a portion of the roll fuser of FIG. 2 which depicts a combination wick holder and release agent dispenser.

According to the present invention, as illustrated in FIGS. 2 and 3, the fuser 24 comprises a heated fuser roll 26 fabricated from a hollow cylinder or core 28 consisting of material having a high coefficient of heat transfer such as copper. A relatively thick (i.e. 60–70 mil) and therefore deformable layer 30 of an elastomer such as silicone rubber is adhered to the core 28. A source of thermal energy such as a quartz lamp 32 is supported internally of the core 28 and is operative upon actuation thereof to elevate the temperature of the surface of the roll 26 to a temperature suitable for softening the toner images carried by the sheets 16.

A backup or pressure roll 34 is supported for pressure engagement with the roll 26 such that the layer 30 is deformed to form a nip 36 through which the sheets 16 pass with toner images 38 electrostatically adhered thereto contacting the layer 30.

A release agent management system generally indicated by reference character 40 is provided for applying a relatively high (60,000 cs) viscosity silicone oil to the surface of the heated fuser roll 26. The oil is applied such that the consumption rate is approximately 1 μl per sheet. The system 40 comprises a combination wick holder and oil dispenser 42. The oil which is contained in a reservoir 44 is pumped, at a rate determined in accordance with the physical characteristics of the system and the required application rate, into the interior 46 of the member 42 by means of a pump 48 connected to an inlet 49. For example, pumping may take place for 45 seconds out of every five minute period of operation of the fuser.

The combination wick holder and dispenser 42 may be fabricated from any suitable material such as aluminum and by any well known manufacturing technique, for example by extrusion. The surface of member 42 is accurate in shape and has attached thereto a compound wick assembly 50 which is also accurate in shape. The assembly 50 comprises a two ply wick arrangement consisting of a relatively thick member 52 and a relatively thin member 54. The member 52 acts as a feeder from orifices or apertures 54 which conveys the oil to the thin member 54. The member 54 contacts the surface of the fuser roll 26 to thereby apply a thin coating of oil thereto. The wick material is preferably Nomex (DuPont trademark for a copolymer of metaphenylenediamine and is isophtaloyl chloride).

As noted hereinbefore, the fuser 24 is adapted to accommodate various size copy sheets as shown in FIG. 3, for example, sheet 16 and sheet 56. As can be seen, the edges of each sheet contact the layer 30 at approximately the same location which corresponds to the registration end 58 of the fuser. The opposite edges of the sheet 16 contact the layer 30 as indicated at 60 while the opposite edge of the sheet 56 contacts the layer as indicated at 62.

As previously noted, the physical characteristics of the layer 30 undergo change either by wear and/or compaction due to the sheet edge contact with the layer. In accordance with the present invention the specific location of the apertures 54 is designed to minimize the effect of the sheet edge contact on the roll. To this end the apertures are positioned substantially opposite the areas of the rolls indicated by reference characters 58, 60, and 62. Thus, each aperture corresponding to a sheet edge is opposite an area of the layer 30 which is approximately one half inch from the area 58, 60, 62 and located inside the paper path. Other apertures which are not opposite sheet edge locations such as the one indicated by reference character 64 are also provided in accordance with the requirements of the system.

Figure 4:
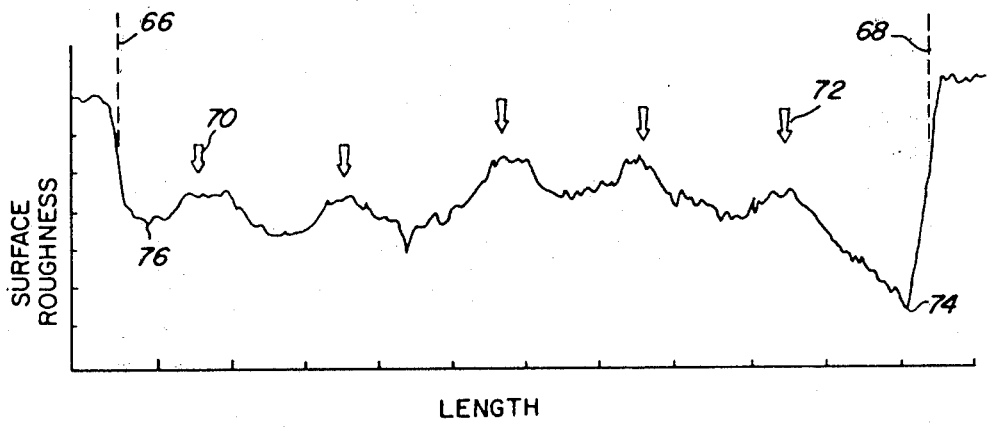
FIG. 4 is a graph depicting the wear profile of a silicone rubber fuser roll illustrating how the location of outlet orifices of the dispenser of FIG. 3 relative to the sheet edges affects roll wear.

The graph illustrated in FIG. 4 shows how the location of the apertures 54 relative to edges 66 and 68 of the copy sheet 16 affects roll wear thereat. Arrows 70 and 72 correspond to the location of two of the apertures 54. It represents a roughness profile of the layer 30 over the length of the fuser roll. As can be seen from FIG. 4, roll wear at a point indicated by reference character 74 is the greatest and is appreciably greater than the roll wear at a point indicated by the reference character 76. This is attributable to the fact that the aperture 72 is a greater distance from the paper edge 68 than the aperture 70 is from the edge 66.

Intermediate points (i.e. those opposite the arrows) on the graph show substantially less physical change in the layer 30. These points were substantially opposite the apertures of the release agent management system employed.

By locating the apertures 54 of the release agent management system of the present invention opposite areas of maximum physical change (i.e. adjacent the areas of sheet edge contact) a system is provided which minimizes the adverse effects of sheet edges contacting the layer 30.

We claim:

1. Roll fuser apparatus comprising:

a pair of fuser rolls one of which is heated and has an elastomeric outer layer, said rolls being sufficiently long to fuse toner images to various sizes of copy sheets passed therebetween wherein the edges of the sheets contact said heated roll at various positions along the longitudinal axis of said fuser rolls;

a release agent management system positioned to contact said heated fuser roll, said system comprising;

a hollow silicone oil containing member;

a compound wick supported by said hollow member, said wick including a relatively thick wick member utilized as a feeder and a relatively thin wick member said relatively thick wick member being in intimate contact with one surface of said hollow member, said relatively thin member being in contact with said outer layer;

said one surface of said hollow member having a plurality of outlet apertures therein, there being one aperture for each of said various positions, each aperture being spaced relative to one of said various positions whereby a quantity of silicone oil is applied to said elastomeric outer layer adjacent said various positions.

2. Apparatus according to claim 1 wherein said outer layer comprises silicone rubber.

3. Apparatus according to claim 2 wherein said release agent comprises a relatively high viscosity silicone oil.

* * * * *